US008466384B2

(12) United States Patent
Villain

(10) Patent No.: US 8,466,384 B2
(45) Date of Patent: Jun. 18, 2013

(54) SLIDING ELECTRICAL SWITCH

(75) Inventor: Jean-Christophe Villain, Dole (FR)

(73) Assignee: CoActive Technologies, LLC, Newton, MA (US)

( * ) Notice: Subject to any disclaimer, the term of this patent is extended or adjusted under 35 U.S.C. 154(b) by 237 days.

(21) Appl. No.: 13/016,625

(22) Filed: Jan. 28, 2011

(65) Prior Publication Data

US 2011/0180378 A1 Jul. 28, 2011

(30) Foreign Application Priority Data

Jan. 28, 2010 (FR) ..... 10 50552

(51) Int. Cl.
*H01H 15/06* (2006.01)

(52) U.S. Cl.
USPC ..... 200/550

(58) Field of Classification Search
USPC ..... 200/16 R, 16 C, 61.74, 61.76, 239, 200/241, 290, 329, 537, 547, 550
See application file for complete search history.

(56) References Cited

U.S. PATENT DOCUMENTS

| | | | | |
|---|---|---|---|---|
| 4,750,090 | A * | 6/1988 | Abe | 361/741 |
| 6,621,018 | B1 * | 9/2003 | Chen | 200/16 C |
| 6,999,675 | B2 * | 2/2006 | Nishiwaki | 396/85 |
| 7,564,004 | B2 * | 7/2009 | Nishimura et al. | 200/536 |
| 7,615,717 | B2 * | 11/2009 | Nakase et al. | 200/536 |
| 7,916,459 | B2 * | 3/2011 | Lee et al. | 361/679.01 |
| 2008/0217156 | A1 | 9/2008 | Nishimura et al. | |
| 2009/0223795 | A1 | 9/2009 | Lee et al. | |

FOREIGN PATENT DOCUMENTS

EP 1351269 A2 8/2003

* cited by examiner

*Primary Examiner* — Edwin A. Leon
*Assistant Examiner* — Anthony R Jimenez
(74) *Attorney, Agent, or Firm* — Fox Rothschild LLP

(57) ABSTRACT

A sliding electrical switch comprising a first slider which is able to establish a first electrical switching channel, a first actuator for the first slider, a second slider which is able to establish a second electrical switching channel, a second actuator for the second slider, and a common return spring which is a compression spring which is mounted axially compressed between the first and second sliders and which simultaneously stresses each of the two sliders towards its idle axial position.

13 Claims, 9 Drawing Sheets

SLIDING ELECTRICAL SWITCH

RELATED APPLICATION AND CLAIM OF PRIORITY

This application claims the priority benefit of France Patent Application 1050552 filed Jan. 28, 2010, the contents of which is hereby incorporated by reference in its entirety.

BACKGROUND

The present disclosure relates to a sliding electrical switch, which is commonly used in various electronic appliances such as a portable computer, or a GSM mobile telephone, or a personal digital assistant PDA.

Such a sliding electrical switch enables its user, via a control or actuation button, to act in two actuation or control directions by displacing the button in these two directions along a main actuation axis which is the sliding axis of this type of switch.

Such a switch is, for example, used to adjust the sound volume, up or down, such an actuation being generally performed by means of a single finger such as the thumb, for example when the electronic appliance is held in one hand and the button is arranged in a lateral edge of the housing of the electronic appliance.

Various electric slider switch designs have been known for very many years. However, none of the known designs can address the various current technical imperatives which notably include high compactness for such a component, in other words the shortest possible length of the component along the sliding axis of the switch, the most constant return force possible felt by the user, in both directions, while having a sufficient actuation travel, in both directions, in order for the user to fully sense his effective action on the button, and therefore on the switch, to establish, in each direction, at least one electrical switching channel at the end of travel, or, in the final part of the travel, to provoke, for example, an increase or reduction in a sound volume, and, finally, a reduced number of components inside the switch.

An electric slider switch is known, for example, from the document U.S. Patent Application Publication No. 2008/0217156 comprising: a switch housing delimiting an internal chamber; a first slider which is arranged in said chamber and which is guided to slide along a horizontal axis of the housing so as to be mounted mobile in a first direction between an idle axial position which is defined by a first fixed end stop element of the housing, and an active axial position in which it cooperates with first electricity conducting means, arranged in the internal chamber, to establish a first electrical switching channel; and a first actuator which is connected in axial translation with the first slider and which extends out of the housing to enable the first slider to be actuated in said first direction towards its active axial position.

The present disclosure aims to propose a switch of this type which is more compact, has a reduced length and has little bulk.

SUMMARY

This disclosure is not limited to the particular systems, devices and methods described, as these may vary. The terminology used in the description is for the purpose of describing the particular versions or embodiments only, and is not intended to limit the scope.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this document is to be construed as an admission that the embodiments described in this document are not entitled to antedate such disclosure by virtue of prior invention. As used in this document, the term "comprising" means "including, but not limited to."

To this end, the present disclosure proposes an electric switch of the type mentioned above, characterized in that it comprises: a second slider which is arranged in said chamber and which is guided to slide along said axis of the housing so as to be mounted mobile in a second direction, opposite to said first direction, between an idle position which is defined by a second fixed end stop element of the housing, and a second active position in which it cooperates with second electricity conducting means, arranged in the internal chamber, to establish a second electrical switching channel; a second actuator which is connected in axial translation with the second slider and which extends out of the housing to enable the second slider to be actuated in said second direction towards its active axial position; and a common return spring which is a compression spring which is mounted axially compressed between the first and second sliders and which simultaneously stresses each of the two sliders towards its idle axial position.

According to other features of the invention, in the idle position of the associated slider, each actuator is arranged axially in the vicinity of the centre of the switch and, in the active position of the associated slider, is arranged in the vicinity of an axial end of the switch. Similarly, in the idle position of the two sliders, the two actuators arranged axially in the vicinity of the centre of the switch define between them a recess which is able to receive a switch control button.

In an alternative embodiment, in the idle position of the associated slider, each actuator is arranged axially in the vicinity of an axial end of the switch and, in the active position of the associated slider, each actuator is arranged in the vicinity of the centre of the switch; the common return spring is a helical compression spring which is guided axially in the housing. Each slider comprises an axial branch for guiding the slider in the housing and a transverse branch, which is arranged at an axial end of the guidance branch, which cooperates with an axial end of the common return spring and which, in the idle position of the slider, is arranged at an axial end of the internal chamber, wherein each slider is generally U-shaped and includes another axial branch for guiding the slider in the housing which is connected to said axial guidance branch by the transverse branch, and the common return spring is housed between the two axial branches of each slider, the other axial guidance branch of a slider bears means which cooperate with said electricity conducting means associated with said slider.

In an alternative embodiment, the transverse branch bears means which cooperate with said electricity conducting means associated with said slider, each slider extends in a horizontal plane and is delimited by two parallel horizontal faces, and the two sliders are superposed in the internal chamber, the axial actuation travels of each of the two sliders are equal, and the switch includes end stop means so as to limit the simultaneous travel, one towards the other, of the two sliders.

BRIEF DESCRIPTION OF THE DRAWINGS

Other features and advantages of the invention will become apparent from reading the following detailed description, for an understanding of which reference should be made to the appended figures in which.

DETAILED DESCRIPTION

For the description of the invention, the vertical, longitudinal and transverse orientations according to the V, L, T coordinate system indicated in the figures will be adopted in a nonlimiting manner.

Figure 1:
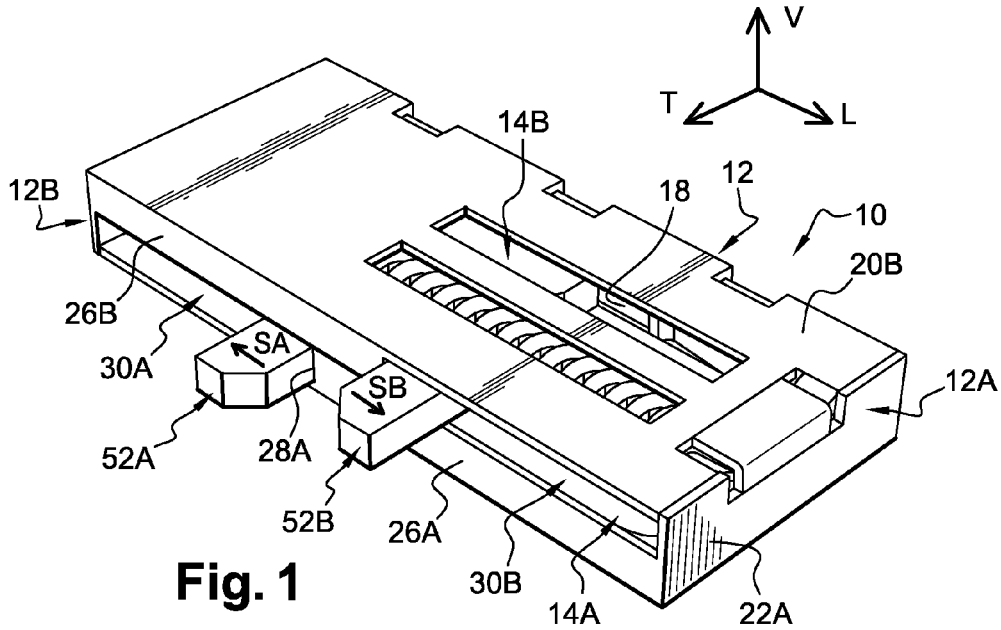
FIG. 1 illustrates a perspective view, from three-quarters front right, of a first exemplary embodiment of an electric slider switch according to the invention.

The left-to-right orientation, along the longitudinal axis L, referring, for example, to FIG. 1, will also be adopted.

In the embodiment that will be described, the electric slider switch 10 comprises, as a nonlimiting example, two identical sliders and two identical half-housings which will be designated by the same reference numerals indexed "A" and "B".

Figure 3:
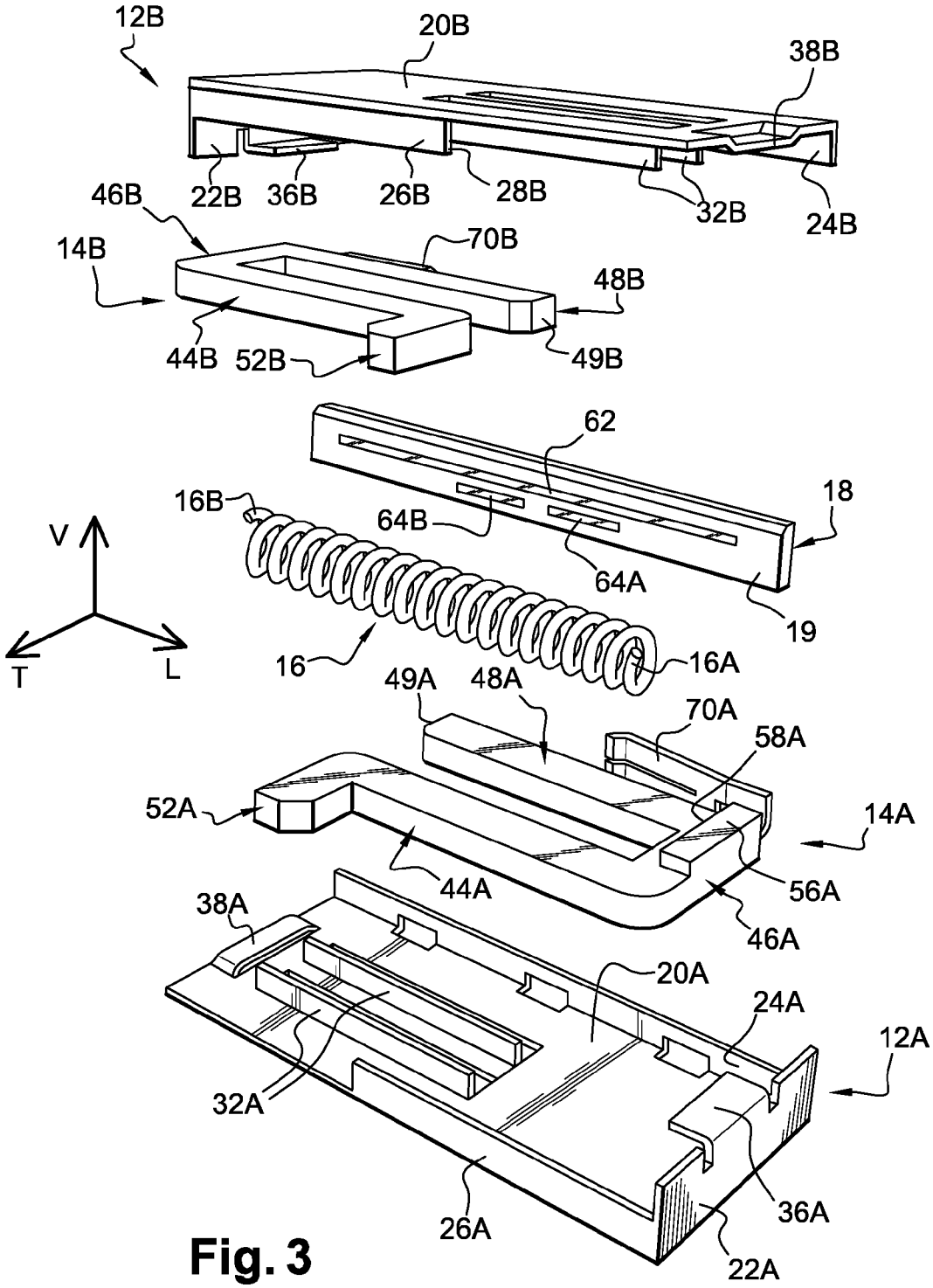
FIG. 3 illustrates a view similar to that of FIG. 1 in which the five main components of the switch are illustrated in exploded fashion.
Figure 4:
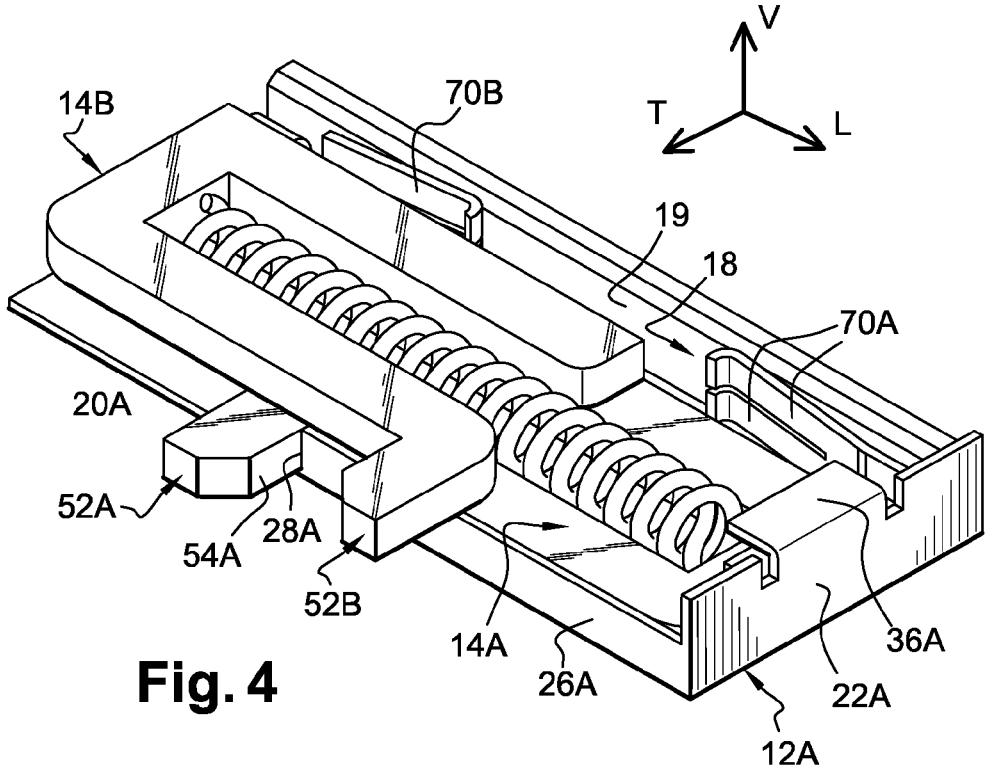
FIG. 4 illustrates a view similar to that of FIG. 1 without the top half-housing.
Figure 6:
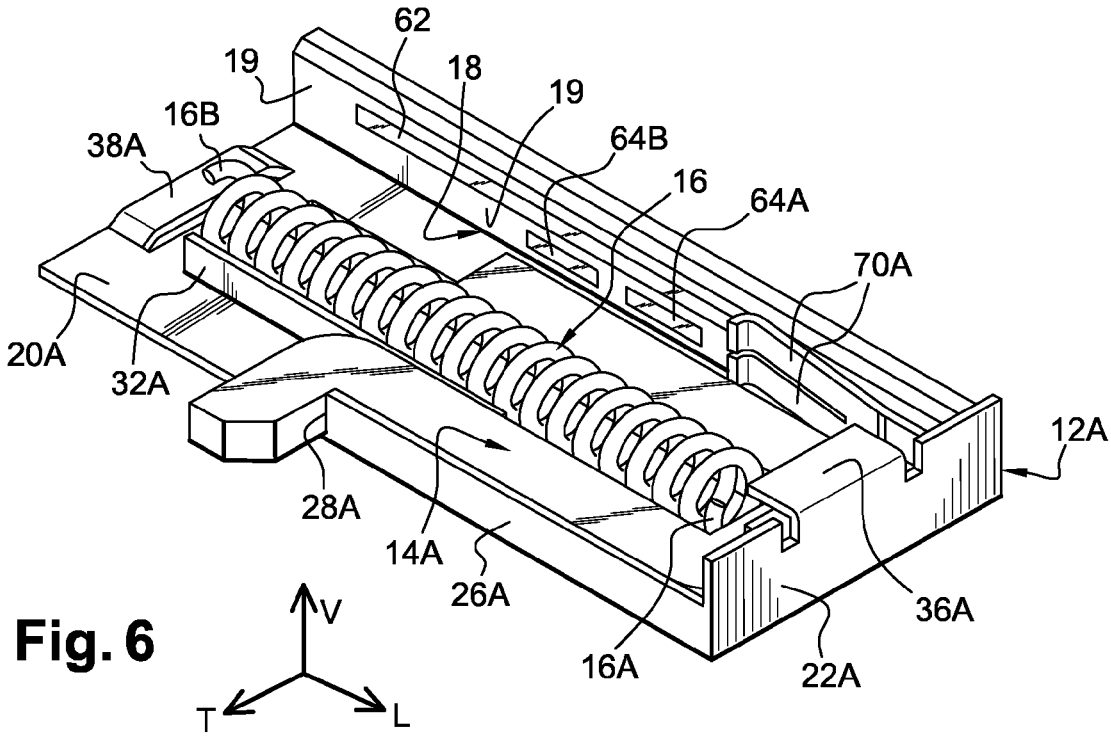
FIG. 6 illustrates a view similar to that of FIG. 4 without the top left slider.

Thus, as can be seen in FIG. 3, the electric switch mainly consists of five components vertically superposed from bottom to top, namely, a bottom half-housing 12A, a bottom right slider 14A, a common return spring 16, a top left slider 14B and a top half-housing 12B.

Also represented, in exploded form, is a strip 18 bearing fixed contacts which can, preferably, be produced in a single piece by overmoulding on the bottom half-housing 12A.

Figure 2:
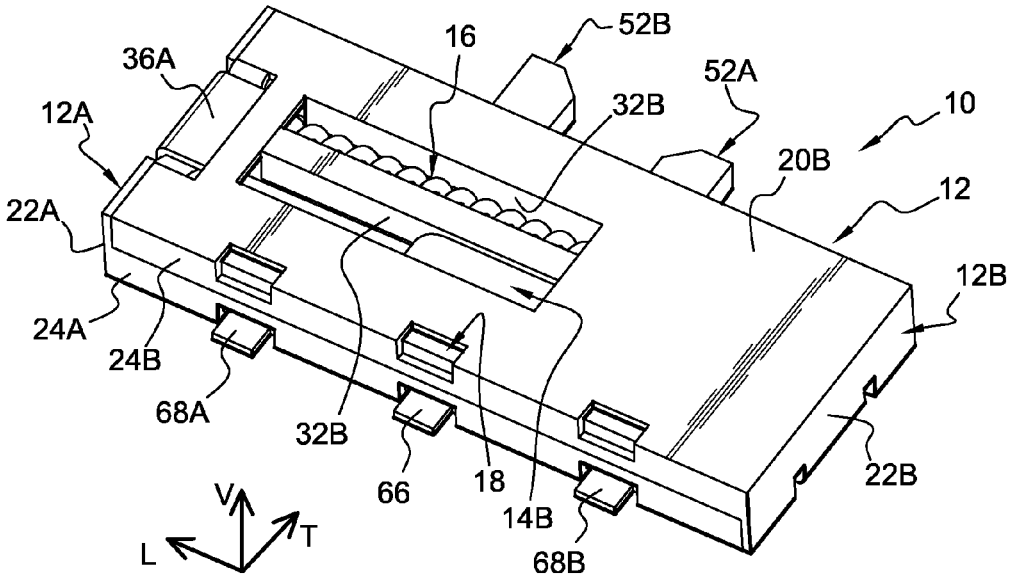
FIG. 2 illustrates a perspective view, from three-quarters rear left, of the switch of FIG. 1.

When assembled together, as represented in FIGS. 1 and 2, the two half-housings 12A and 12B form a flat rectangular parallelepipedal housing 12 of generally horizontal orientation.

To this end, each half-housing 12A, 12B, which is here produced from cut and folded steel plate, comprises a main horizontal plate 20A, 20B, a transverse vertical end plate 22A, 22B, a longitudinal vertical rear plate 24A, 24B, and a longitudinal vertical front plate 26A, 26B.

The two rear plates 24A and 24B extend over the entire length and over half the height of the housing 12.

Each longitudinal front plate 26A, 26B extends over only a part of the length of the half-housing and is delimited by a vertical end edge 28A, 28B so as to define, in cooperation with the facing longitudinal front face 26B, 26A, a longitudinal slot 30A, 30B which is transversely open towards the front.

Each main horizontal plate 20A, 20B comprises a pair of parallel vertical and longitudinal guideways 32A and 32B, made of the same material by cutting and folding, which are aligned in pairs so that, once the two half-housings are assembled together, the pairs of guideways, in addition to their function for guiding the sliding of the associated slider, delimit a longitudinal channel 34 which houses and guides the return spring 16.

Each half-housing 12A, 12B includes complementary means 36A, 36B and 38A, 38B which allow for the relative positioning and fixing of the two half-housings 12A and 12B, for example by crimping and/or welding.

Figure 5:
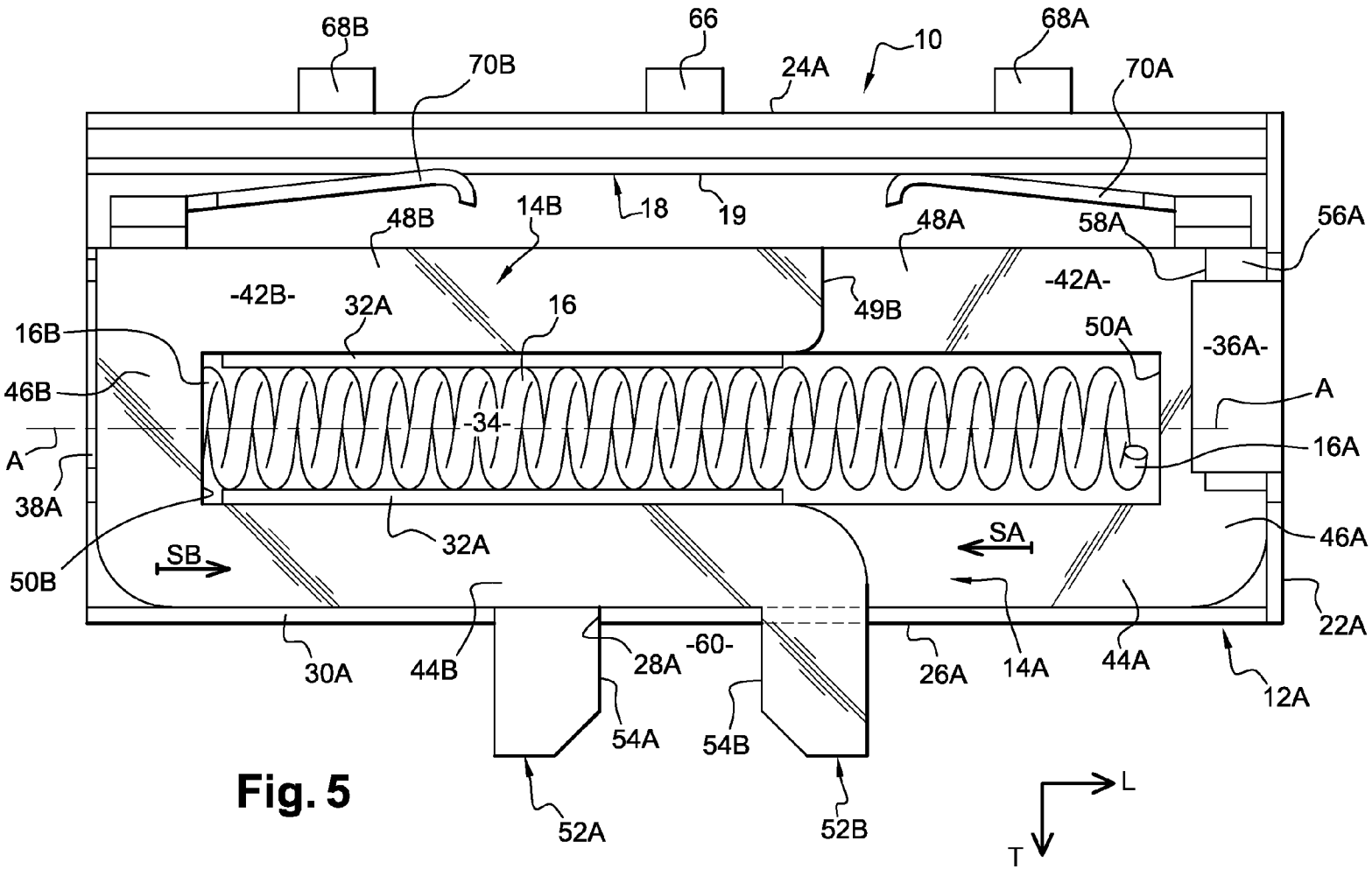
FIG. 5 illustrates a plan view of the switch illustrated in FIG. 4.
Figure 7:
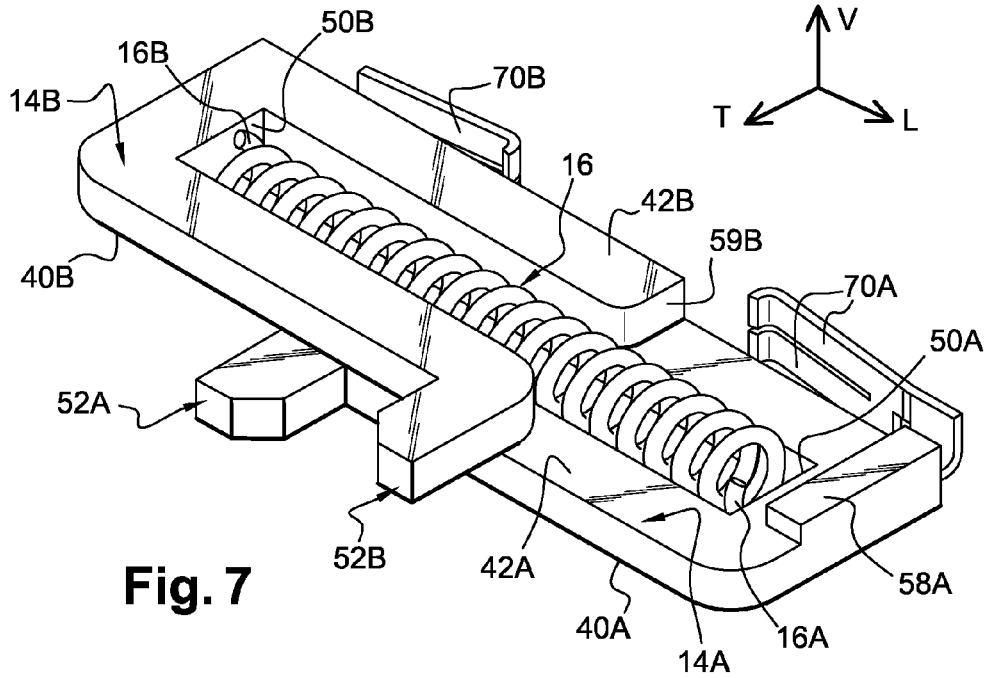
FIG. 7 illustrates a view similar to that of FIG. 4 without the bottom half-housing.

Each slider 14A, 14B has, in plan view, and as can be seen for example in FIG. 5, a generally recumbent U-shape.

Each slider is designed to slide axially in the housing 12 along the sliding axis A-A which extends in the main longitudinal direction "L" of the housing 12.

To this end, each slider 14A, 14B is guided to slide mainly in its associated half-housing 12A, 12B, notably by means of the associated guideways 32A, 32B.

To this end, each slider, which here is a moulded piece made of insulating plastic material, is delimited by two parallel and opposite horizontal faces 40A, 40B and 42A, 42B.

In the mounted position, the two opposite and facing faces 42A and 40B of the two sliders 14A and 14B can slide one over the other, whereas the faces 40A and 42B slide along facing faces of the main plates 20A and 20B of each associated half-housing 12A, 12B.

Each slider 14A, 14B has a first main axial branch 44A, 44B for guiding the slider, a second axial guidance branch 48A, 48B and a transverse branch 46A, 46B which interconnects the two axial guidance branches 44A, 48A and 44B, 48B respectively.

Each pair of axial guidance branches delimits, by their facing vertical and longitudinal faces, a guidance channel in which the associated parallel guideways 32A, 32B are received so as, on the one hand, to transversely position each slider in the housing 12 and, on the other hand, to axially guide each slider 14A, 14B to slide along the axis A.

In all the FIGS. 1 to 8, the two sliders 14A and 14B are each illustrated in their idle axial position towards the right and towards the left respectively, idle positions towards which they are returned simultaneously by the single common return spring 16 which is the helical compression spring which is housed in the channel 34 and of which each of the opposite axial ends 16A, 16B bears axially against the facing vertical and transverse face 50A, 50B of an associated transverse branch 46A, 46B.

Thus, in the idle position, each transverse branch 46A, 46B is arranged at an axial end of the internal chamber of the housing 12, that is to say in proximity to, or against, the facing face of the associated transverse vertical end plate 22A, 22B.

Against the elastic return force which is applied to it by the spring 16, each slider 14A, 14B is able to slide in the housing 12, from its idle position, in an associated actuation direction SA, SB, towards an active axial position at the end of a determined actuation travel.

To allow for the actuation of each slider 14A, 14B, each slider is associated with an actuator 52A, 52B which extends out of the housing 12.

Each actuator 52A, 52B here consists of a transverse tab arranged at the central free end of the first axial guidance branch 44A, 44B which extends transversely and horizontally out of the housing 12 through the associated slot 30A, 30B.

In addition to its function as actuator for the associated slider, each transverse tab 52A, 52B constitutes an end stop which, in cooperation with the vertical end edge 28A, 28B, defines the idle axial position of the associated slider 14A, 14B.

According to a variant that is not represented, the idle position of each slider can be defined by the abutment of the transverse branch 46A, 46B against the facing internal vertical face of the plate 22A, 22B.

In the idle position of the two sliders, and as can be seen notably in FIG. 5, each actuator 52A, 52B is arranged axially in the vicinity of the centre of the switch 10 and, in the active position at the end of the displacement in the direction SA, SB, each actuator 52A, 52B will be situated in the vicinity of the associated axial end of the chamber 22A, 22B, that is to say that each actuator 52A reaches the opposite longitudinal end of the slot 30A, 30B in which it can be axially displaced in the direction "L".

In the idle central position, the two actuators 52A, 52B delimit between them a central space, or recess, 60 which is more specifically axially delimited by the facing transverse vertical faces 54A, 54B of the two actuators.

Thus, the recess 60 is transversely open towards the front and vertically towards the top and bottom.

The recess 60 is able to receive a control or actuation button (not represented) for the switch which makes it possible to act axially on one or other of the two actuators 52A, 52B.

The longitudinal dimension of the part of the control button which projects and which is received in the recess 60 is preferably greater than the axial distance separating the faces 54A, 54B so that it is received without axial play with a slight axial crimping effect by the two actuators under the action of the return spring 16.

The control of the two sliders 14A, 14B can obviously be independent, that is to say by acting directly on the actuator 52A, 52B or by means of two associated distinct buttons, depending on the applications of the switch.

In order to avoid too great an "overlapping" of the two sliders in the case where they would be actuated simultaneously, end stop means are provided so as to limit the simultaneous travel, one towards the other, of the two sliders 14A, 14B.

To this end, the transverse branch 46A, 46B includes an end stop 56A, 56B formed by an extra thickness towards the inside which is delimited by a transverse vertical face 58A, 58B which is able to axially butt against the facing transverse vertical face 49B, 49A of the axial guidance branch 48B, 48A of the other slider.

Figure 8:
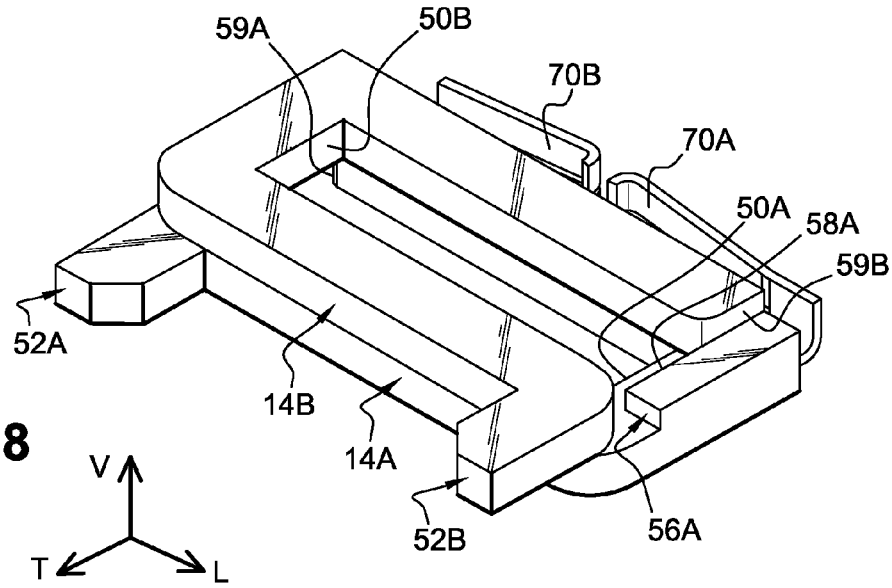
FIG. 8 illustrates a view similar to that of FIG. 4 without the bottom half-housing and without the common return spring and in which the two sliders are illustrated in a maximum mutual convergence position.

Thus, FIG. 8 theoretically represents the maximum relative axial position of the two sliders 14A, 14B in convergence towards one another with the reciprocal abutment of the two sliders. The purpose of displacing each slider 14A, 14B from its idle axial position towards its active axial position is to establish a switching channel. To this end, as a nonlimiting example, the figures show, and notably in FIGS. 3 and 6, on the internal longitudinal and vertical face 19 of the strip 18, fixed conductive tracks including a top common central conductive track 62 and two central and opposite bottom tracks 64A and 64B.

The common top track 62 is, for example, linked to an electrical neutral, via a central electrical connection tab 66, whereas each of the two lateral bottom tracks 64A, 64B is linked to an associated connection terminal 68A, 68B.

In order to establish respective electrical switching channels between the tracks 62 and 64A by means of the slider 14A, on the one hand, and the tracks 62 and 64B by means of the slider 14B, on the other hand, each slider 14A, 14B bears an associated mobile contact 70A, 70B which is here produced in the form of a metallic contact wiper with two superposed branches 70A, 70B.

Obviously, the design according to the invention of an electric slider switch is not limited to this type of fixed and mobile contacts, each slider being able, for example, at the end of travel, to act mechanically on a fixed elastically deformable member which, in turn, establishes an electrical switching channel between two fixed contacts.

As a dimensional example, the design according to the invention makes it possible to have a switch 10 whose overall axial length is equal to approximately 8 millimetres with a recess 60 of axial length, between the faces 54A and 54B, equal to approximately 1 millimetre.

The axial travel of each slider 14A, 14B is substantially equal to 2.5 millimetres with a spring whose axial length, in the idle position of the two sliders, is approximately 7 millimetres.

In the actuation position of one or other of the two sliders, the axial length of the spring 16 is equal to approximately 4.5 millimetres.

There now follows a description of the second exemplary embodiment illustrated in FIGS. 9-14. For this description, which will be given in comparison to that of the first exemplary embodiment, the same numeric and alphanumeric references as those used previously will be used. The housing 12 is produced in two parts, bottom 12A and top 12B. The bottom half-housing 12A is a moulded piece made of plastic material in which the two right 14A and left 14B sliders are guided to slide, and which also includes, still in its front part, the longitudinal recess or channel 34, in the form of a concave half-cylinder open towards the top which houses and guides the common return spring 16.

For the sliding guidance of the two sliders, the bottom half-housing 12A includes a longitudinal guideway 32A which is vertically open upwards. The top half-housing 12B is in this case a piece made of folded and cut steel plate which forms a lid sealing the bottom half-housing 12A. To this end, in addition to its main horizontal top plate 20B, the top half-housing 12B has two transverse and vertical lateral walls 22B which, in the mounted and sealed position of the switch, extend vertically along the transverse and vertical end lateral faces 22A of the bottom half-housing 12A.

For the attachment and fixing of the top half-housing 12B on the bottom half-housing 12A, the lateral walls 22B each include a cutout 38B which receives a complementary and associated stub 36A formed as a projection on a lateral face 22A. The top plate 20B includes a central boss 21B which follows the shape of the spring 16. In the closed position, the bottom face of the top plate 20B bears against the top face of the bottom plate 20A so as, notably, to enclose the two sliders 14A and 14B and the spring 16.

In the closed position, the two half-housings delimit, in the front vertical and longitudinal face of the switch 10, a longitudinal and horizontal slot 30 which is open transversely towards the front and which is common to both sliders 14A and 14B. This slot 30 is longitudinally delimited by two opposite vertical end edges 28A.

Figure 10:
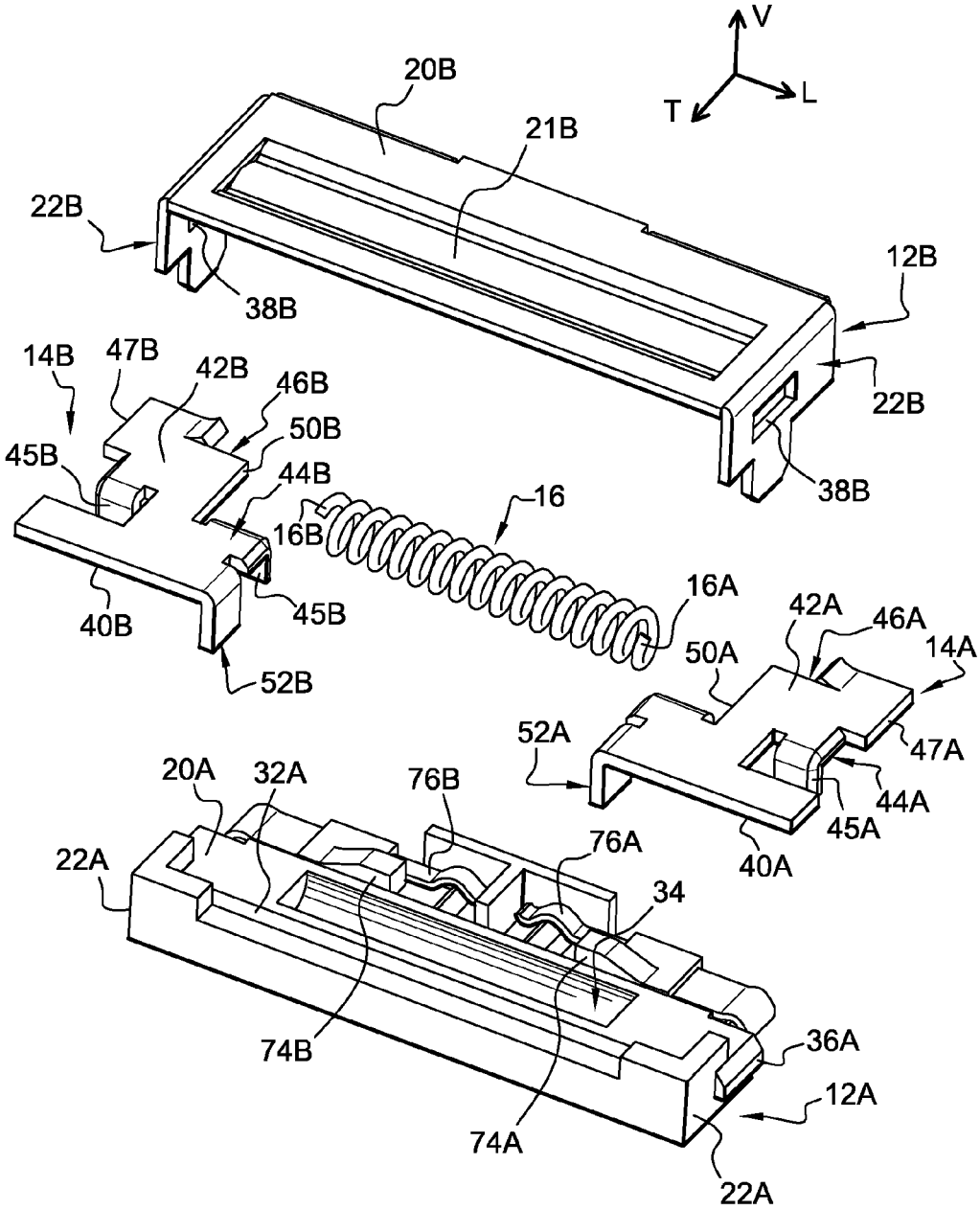
FIG. 10 illustrates a view similar to that of FIG. 9 in which the five main components of the switch are illustrated in exploded fashion.
Figure 14:
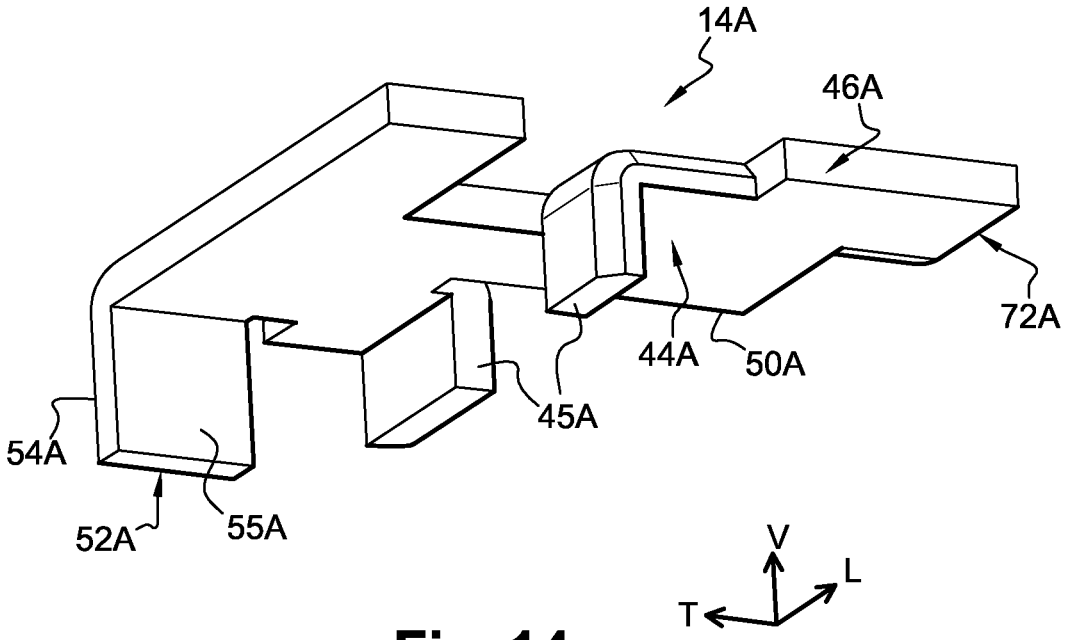
FIG. 14 illustrates a perspective larger scale view from three-quarters below of the right slider of the switch of FIG. 10.

As can be seen more particularly in FIGS. 10 and 14, each slider 14A, 14B is in this case a piece made of cut and folded steel plate. Each slider is in this case guided to slide in the bottom housing 12 which contains the guideway 32A. To this end, each slider is also delimited by its two parallel and opposite horizontal faces 40A, 40B and 42A, 42B.

In the mounted position, the two bottom faces 40A, 40B can slide on the bottom plate 20A, whereas the two top faces 42A, 42B slide along the bottom face of the top main plate 20B. Each slider 14A, 14B has a first main axial branch 44A, 44B which is the main axial guidance branch of the slider and which, to this end, includes two downwardly oriented vertical tabs 45A, 45B which are longitudinally aligned and which are received for guidance and sliding in the common guideway 32A.

Each slider 14A, 14B also includes a transverse branch 46A, 46B which extends transversely towards the rear in the same plane as the associated longitudinal branch 44A, 44B.

Each of the transverse branches 46A, 46B has a vertical and transverse face 50A, 50B and each of these two facing faces 50A and 50B cooperates with the corresponding axial end 16A, 16B of the common return spring 16.

In all the FIGS. 9 to 13, the two sliders 14A and 14B are each illustrated in their idle axial position towards the right and towards the left respectively, idle positions towards which they are returned by the single common return spring 16 and in which each transverse branch 46A, 46B is globally arranged at an axial end of the internal chamber of the housing 12, that is to say in proximity to the transverse face 22A.

To enable each slider 14A, 14B to be actuated, each is associated with an actuator 52A, 52B which extends out of the housing 12 and which in this case consists of a transverse and vertical tab produced in a single piece with the slider.

The idle axial position of each slider is in this case provided by the cooperation of a vertical and transverse end edge 47A, 47B of the transverse branch 46A, 46B which, under the action of the spring 16, bears axially, respectively towards the right and towards the left, against a facing portion of the internal face of the vertical lateral plate 22B of the top half-housing 12B.

Figure 9:
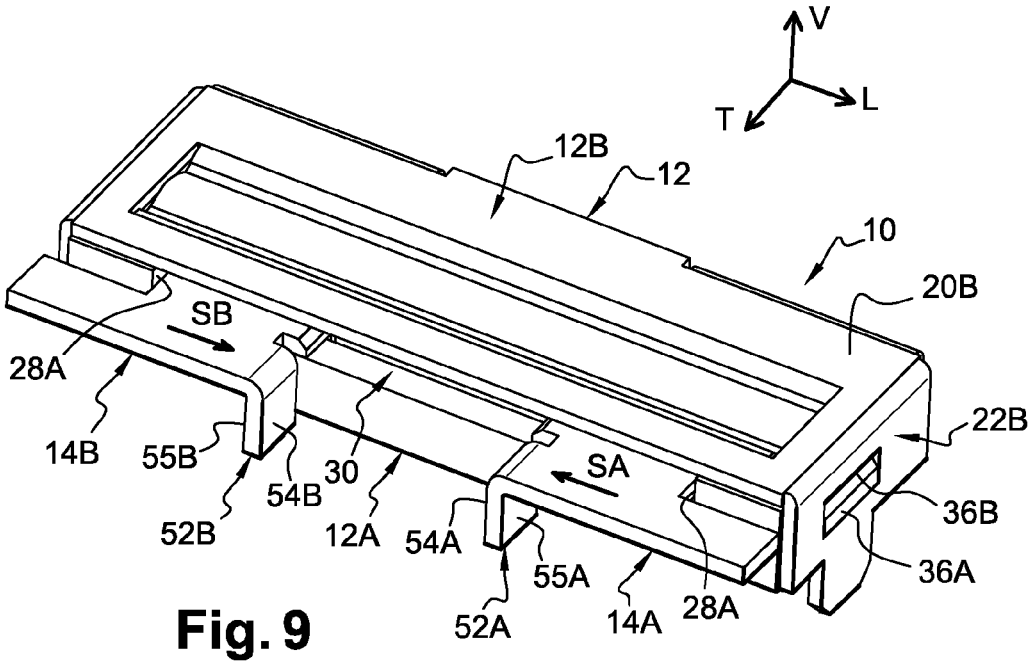
FIG. 9 illustrates a view similar to that of FIG. 1 which illustrates a second exemplary embodiment of an electric slider switch according to the invention.
Figure 11:
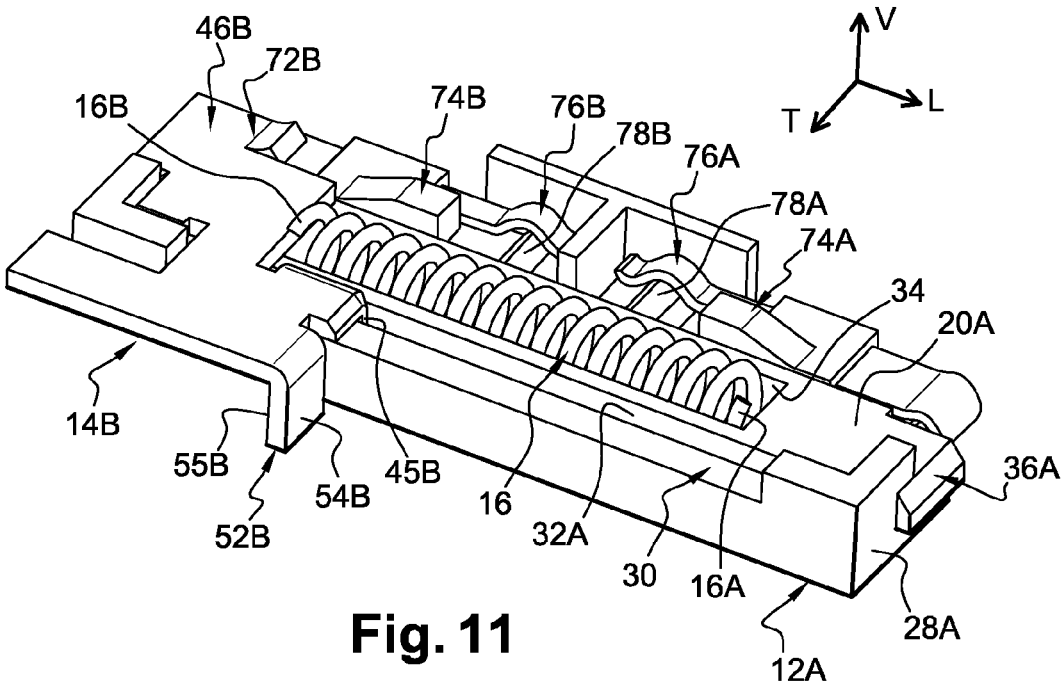
FIG. 11 illustrates a view similar to that of FIG. 10 without the lid-forming top half-housing and without the right slider.

In the idle position of the two sliders 14A, 14B, and as can be seen notably in FIG. 9, each actuator 52A, 52B is arranged axially in the vicinity of an axial end of the switch 10 and, in the active position at the end of the displacement in the direction SA, SB, each actuator 52A, 52B will be situated in the vicinity of the centre of the switch.

For the actuation of the switch 10 in either direction, the electronic appliance includes a control or actuation button (not represented) for the switch which makes it possible to act axially on one or other of the two actuators 52A, 52B. To this end, the button includes two fingers, or has the appearance of a fork, so as to cooperate alternately with an external transverse vertical face 55A, 55B of the actuator 52A, 52B.

As previously, the dimensions of the control button and the distance separating, when idle, the faces 55A and 55B are such that the two actuators 52A, 52B are received without axial play with a slight axial crimping effect in the control button. The control of the two sliders 14A, 14B may obviously be independent.

Generally, if the actuation is independent, the relative travel one towards the other of the two sliders is limited by the abutment of the facing faces 54A, 54B of the two actuators 52A, 52B.

Regarding the electrical contact elements of the switch making it possible, depending on the idle or active position of a slider 14A, 14B, to make or break an electrical switching channel, the rear transverse end 72A, 72B of each transverse branch 46A, 46B can cooperate with a ramp 74A, 74B which is overmoulded on an elastically deformable mobile contact 76A, 76B which is borne by the insulating bottom half-housing 12A and which, under the action of the ramp 74A, 74B, can be elastically deformed to establish an electrical switching channel with a facing fixed contact 78A, 78B.

Figure 12:
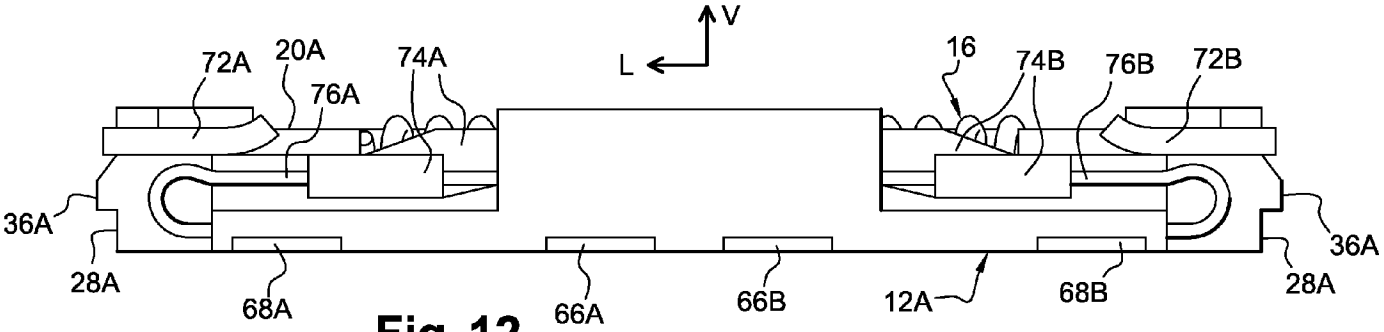
FIG. 12 illustrates a rear view in elevation of the switch of FIG. 1 without the lid-forming top half-housing.
Figure 13:
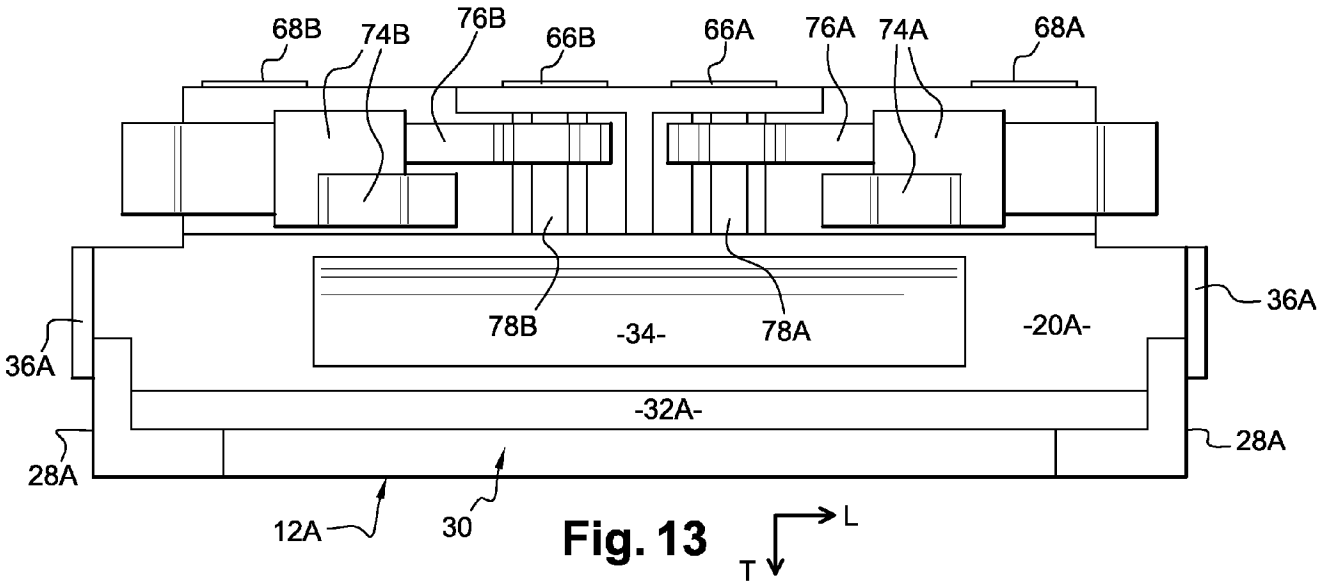
FIG. 13 illustrates a plan view in elevation of the bottom half-housing of the switch of FIG. 10.

As can be seen in FIG. 12, each mobile contact 76A, 76B is connected to an associated connection terminal 68A, 68B, whereas each fixed contact 78A, 78B is connected to a connection terminal 66A, 66B.

As for the first exemplary embodiment, the axial travel of each slider 14A, 14B is substantially equal to 2.5 millimetres.

The overall dimensions of the switch 10 are approximately 9 millimetres in length, by 3 millimetres in transverse width, and by 1.2 millimetres in height.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

The invention claimed is:

1. An electric slider switch comprising:

a switch housing delimiting an internal chamber;

a first slider, arranged in said internal chamber and which is guided to slide along a horizontal axis of the switch housing so as to be movably mounted in a first direction between an idle axial position which is defined by a first fixed end stop element of the switch housing, and an active axial position in which it contacts a first electricity conducting means, arranged in the internal chamber, to establish a first electrical switching channel;

a first actuator which is connected in axial relationship with the first slider and which extends out of the switch housing to enable the first slider to be actuated in said first direction towards its active axial position;

a second slider, arranged in said internal chamber and which is guided to slide along said axis of the switch housing so as to be movably mounted in a second direction, opposite to said first direction, between an idle position which is defined by a second fixed end stop element of the switch housing, and a second active position in which it contacts a second electricity conducting means, arranged in the internal chamber, to establish a second electrical switching channel;

a second actuator which is connected in axial relationship with the second slider and which extends out of the switch housing to enable the second slider to be actuated in said second direction towards its active axial position; and a common return spring that is a compression spring that is mounted axially compressed between the first and second sliders and which simultaneously stresses each of the two sliders towards their respective idle axial positions.

2. The switch according to claim 1, characterized in that, in the idle position of the associated slider, each actuator is axially arranged in the vicinity of the centre of the switch and, in the active position of the associated slider, is arranged in the vicinity of an axial end of the switch.

3. The switch according to claim 2, characterized in that, in the idle position of the two sliders, the two actuators axially arranged in the vicinity of the centre of the switch define between them a recess which is able to receive a switch control button.

4. The switch according to claim 1, characterized in that, in the idle position of the associated slider, each actuator is axially arranged in the vicinity of an axial end of the switch and, in the active position of the associated slider, each actuator is arranged in the vicinity of the centre of the switch.

5. The switch according to claim 1, characterized in that the common return spring is a helical compression spring that is guided axially in the switch housing.

6. The switch according to claim 1, characterized in that each slider comprises:

an axial guidance branch for guiding the slider in the switch housing; and a transverse branch, that is arranged at an axial end of the axial guidance branch, that cooperates with an axial end of the common return spring and that, in the idle position of the slider, is arranged at an axial end of the internal chamber.

7. The switch according to claim 6, characterized in that each slider is generally U-shaped and includes another axial branch for guiding the slider in the switch housing that is connected to said axial guidance branch by the transverse branch, and in that the common return spring is housed between the two axial branches of each slider.

8. The switch according to claim 7, characterized in that said other axial guidance branch of a slider bears means which cooperate with said electricity conducting means associated with said slider.

9. The switch according to claim 6, characterized in that said transverse branch bears means which cooperate with said electricity conducting means associated with said slider.

10. The switch according to claim 1, characterized in that each slider extends in a horizontal plane and is delimited by two parallel horizontal faces, and in that the two sliders are superposed in the internal chamber.

11. The switch according to claim 1, characterized in that the axial actuation travel of each of the two sliders is equal.

12. The switch according to claim 1, characterized in that it includes an end stop means so as to limit the simultaneous travel, one towards the other, of the two sliders.

13. An electric slider switch comprising:

a switch housing delimiting an internal chamber;

a first slider, arranged in said internal chamber and which is guided to slide along a horizontal axis of the switch housing so as to be movably mounted in a first direction between an idle axial position which is defined by a first fixed end stop element of the switch housing, and an active axial position in which it contacts a first electricity conducting means, arranged in the internal chamber, to establish a first electrical switching channel;

a first actuator which is connected in axial relationship with the first slider and which extends out of the switch housing to enable the first slider to be actuated in said first direction towards its active axial position;

a second slider, arranged in said internal chamber and which is guided to slide along said axis of the switch housing so as to be movably mounted in a second direction, opposite to said first direction, between an idle position which is defined by a second fixed end stop element of the switch housing, and a second active position in which it contacts a second electricity conducting means, arranged in the internal chamber, to establish a second electrical switching channel;

a second actuator which is connected in axial relationship with the second slider and which extends out of the switch housing to enable the second slider to be actuated in said second direction towards its active axial position;

wherein, in the idle position of the associated slider, each actuator is axially arranged in the vicinity of the centre of the switch and, in the active position of the associated slider, is arranged in the vicinity of an axial end of the switch; and a common return spring that is a compression spring that is mounted axially compressed between the first and second sliders and which simultaneously stresses each of the two sliders towards their respective idle axial positions.

* * * * *